US010697615B1

(12) United States Patent
Rashidi Doust

(10) Patent No.: US 10,697,615 B1
(45) Date of Patent: Jun. 30, 2020

(54) LIGHT FIXTURE WITH LCD OPTIC ELEMENT

(71) Applicant: ELITE LIGHTING, Commerce, CA (US)

(72) Inventor: Hamid Rashidi Doust, Beverly Hills, CA (US)

( * ) Notice: Subject to any disclaimer, the term of this patent is extended or adjusted under 35 U.S.C. 154(b) by 0 days.

(21) Appl. No.: 16/406,572

(22) Filed: May 8, 2019

Related U.S. Application Data

(60) Provisional application No. 62/668,773, filed on May 8, 2018.

(51) Int. Cl.

| | |
|---|---|
| ***F21V 14/00*** | (2018.01) |
| ***F21V 29/70*** | (2015.01) |
| ***F21V 21/15*** | (2006.01) |
| ***F21V 23/00*** | (2015.01) |
| ***F21V 21/30*** | (2006.01) |
| *F21Y 115/10* | (2016.01) |

(52) U.S. Cl.
CPC ..... *F21V 14/003* (2013.01); *F21V 21/15* (2013.01); *F21V 21/30* (2013.01); *F21V 23/005* (2013.01); *F21V 29/70* (2015.01); *F21Y 2115/10* (2016.08)

(58) Field of Classification Search
CPC ..... F21V 14/003; F21V 21/04–049; F21V 21/14–32; F21S 8/02–046
See application file for complete search history.

(56) References Cited

U.S. PATENT DOCUMENTS

| | | | | |
|---|---|---|---|---|
| 7,538,830 | B2 * | 5/2009 | Sasuga | F21V 14/003 349/57 |
| 10,072,806 | B1 * | 9/2018 | Yarnell | F21V 5/04 |
| 10,145,519 | B1 * | 12/2018 | Portinga | F21V 15/01 |
| 2009/0225400 | A1 * | 9/2009 | Ansems | F21V 14/003 359/315 |
| 2010/0148688 | A1 * | 6/2010 | Hikmet | F21V 14/003 315/250 |
| 2015/0062907 | A1 * | 3/2015 | Ng | F21V 9/40 362/293 |

(Continued)

FOREIGN PATENT DOCUMENTS

| | | | | |
|---|---|---|---|---|
| CN | 202056702 U | * | 11/2011 | |
| WO | WO-2005121641 A1 | * | 12/2005 | F21V 14/003 |

OTHER PUBLICATIONS

Eulum Design, Before May 8, 2018.

*Primary Examiner* — Mariceli Santiago
(74) *Attorney, Agent, or Firm* — Payam Moradian

(57) ABSTRACT

A light fixture may include a fixture body configured for attachment to a support structure, such as a ceiling. A fixture housing may be fastened to the fixture body and an electronics board may be attached to an interior of the housing. A lens may be in optical communication with an LED light source on the board and an LCD optic element may be located on a surface of the lens opposite the board. An optical property of light emitted from the light fixture may be based on a current level applied to the LCD optic element. The fixture body may include a cylinder with the fixture housing (which may also be cylindrical) being fastened to a circular surface of the cylinder. The cylinder may include a connector, on the other circular surface of the cylinder or on the rectangular surface of the cylinder, for attachment to the support structure.

18 Claims, 10 Drawing Sheets

(56) References Cited

U.S. PATENT DOCUMENTS

| | | | | |
|---|---|---|---|---|
| 2016/0178157 | A1* | 6/2016 | Li | F21V 3/06<br>362/363 |
| 2016/0252235 | A1* | 9/2016 | Benner | F21V 23/0435<br>362/257 |
| 2017/0138576 | A1* | 5/2017 | Peng | F21S 8/02 |

* cited by examiner

LIGHT FIXTURE WITH LCD OPTIC ELEMENT

CROSS-REFERENCE TO RELATED APPLICATIONS

This application claims the benefit of priority to U.S. provisional application Ser. No. 62/668,773, filed on May 8, 2018, the contents of which are hereby incorporated by reference.

TECHNICAL FIELD

The present disclosure relates generally to light fixtures. More specifically the disclosure relates to light fixtures, with a controllable LCD optic element, that are attached to support structures using a variety of distinct light fixture shapes.

BACKGROUND

Wirelessly controllable light fixtures may not come provided with means for attaching them to a variety of support structures such as walls and ceilings. A traditional light fixture may include means for attaching itself to one type of support structure (e.g., wall or ceiling) via one type of connection (e.g., hanging from a ceiling). Therefore, these types of light fixtures do not provide any flexibility in regards to the type of support structure required for attachment or to the type of connection used for attaching the light fixture to the support structure.

BRIEF DESCRIPTION OF THE DRAWINGS

In the drawings, which are not necessarily drawn to scale, like numerals may describe similar components in different views. Like numerals having different letter suffixes may represent different instances of similar components. Some embodiments are illustrated, by way of example, and not limitation, in the figures of the accompanying drawings.

DETAILED DESCRIPTION

Described herein is a light fixture that may be attached to various types of support structures and remotely controlled through a wireless protocol, such as Bluetooth®. The light fixture may be controlled and manipulated, for example, with an, application running on an electronic device such as a smart phone. This may allow an intensity, color and/or angle of the light to be changed remotely.

The light fixture may include a liquid crystal (LCD) optic element. Depending on a voltage/current of the light fixture an optical property of the LCD optic element may change, resulting in light with different optical properties being emitted, from the light fixture.

Figure 1:
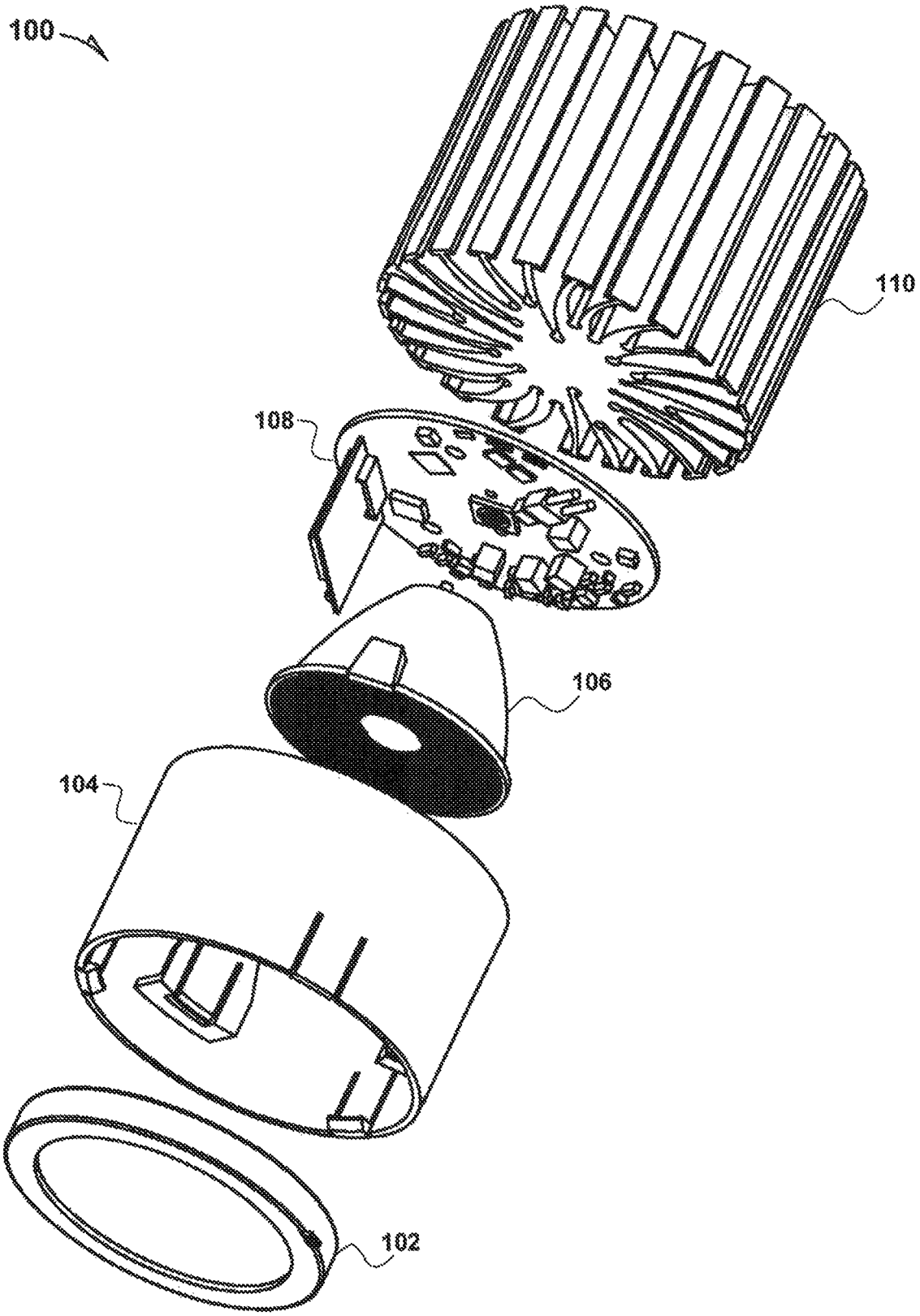
FIG. 1 shows components of a light fixture with remotely controlled optics, consistent with some embodiments described herein.

FIG. 1 shows components of a light fixture 100 with remotely controlled optics, consistent with some embodiments described herein.

The components of the light fixture 100 may include an LCD optic element 102, a light fixture housing 104, a lens 106, an electronics board 108 and a heat sink 110. The electronics board 108 may mechanically support and electrically connect electronic components or electrical components of the light fixture 100 using conductive tracks, pads and other features etched from one or more sheet layers of copper laminated onto and/or between sheet layers of a non-conductive substrate. Components may be soldered onto the electronics board 108 to both electrically connect and mechanically fasten them to the electronics board 108. For example, the electronics board 108 may include a light emitting diode (LED) light source and a wireless (e.g., Bluetooth®) chip. In one embodiment, the electronics board 108 may also include multiple LEDs with different colors.

The LCD optic element 102 may be an electronically modulated optical device that uses the light-modulating properties of liquid crystals. Liquid crystals do not emit light directly, instead using a backlight or reflector (e.g., the LED light source of electronics board 108) to produce images in color or monochrome. LCDs may use the same basic technology as other types of displays, except that a large number of small pixels are used, while other displays may have larger pixel elements. Each pixel of the LCD optic element 102 may consist of a layer of molecules aligned between two transparent electrodes, and two polarizing filters (parallel and perpendicular), the axes of transmission of which may be perpendicular to each other. Without the liquid crystal between the polarizing filters, light passing through the first filter would be blocked by the second (crossed) polarizer. Before an electric field is applied to the liquid-crystal molecules, the orientation of the liquid-crystal molecules may be determined by the alignment at the surfaces of the two transparent electrodes. Accordingly, optical properties of the light emitted from the LCD optic element 102 may be based on a current/voltage level applied to the liquid-crystal molecules.

The lens 106 may be a transmissive optical device that focuses or disperses a light beam (e.g., the LED light source of electronics board 108) by means of refraction. The lens 106 may simply consist of a single piece of transparent material (e.g., glass) or it may consist of several simple lens elements, usually arranged along a common axis. The lens 106 may be made from materials such as glass or plastic which are ground and polished or molded to a desired shape.

The heat sink 110 may be a passive heat exchanger that transfers the heat generated by the electronics board 108 to a fluid medium coolant (e.g., air or a liquid), where it is dissipated away from the electronics board 108, thereby allowing for regulation of the board's temperature. The heat sink 110 may be especially useful with respect to LED light sources (of the electronics board 108), which would not normally have sufficient heat dissipation ability to moderate its temperature.

Figure 2:
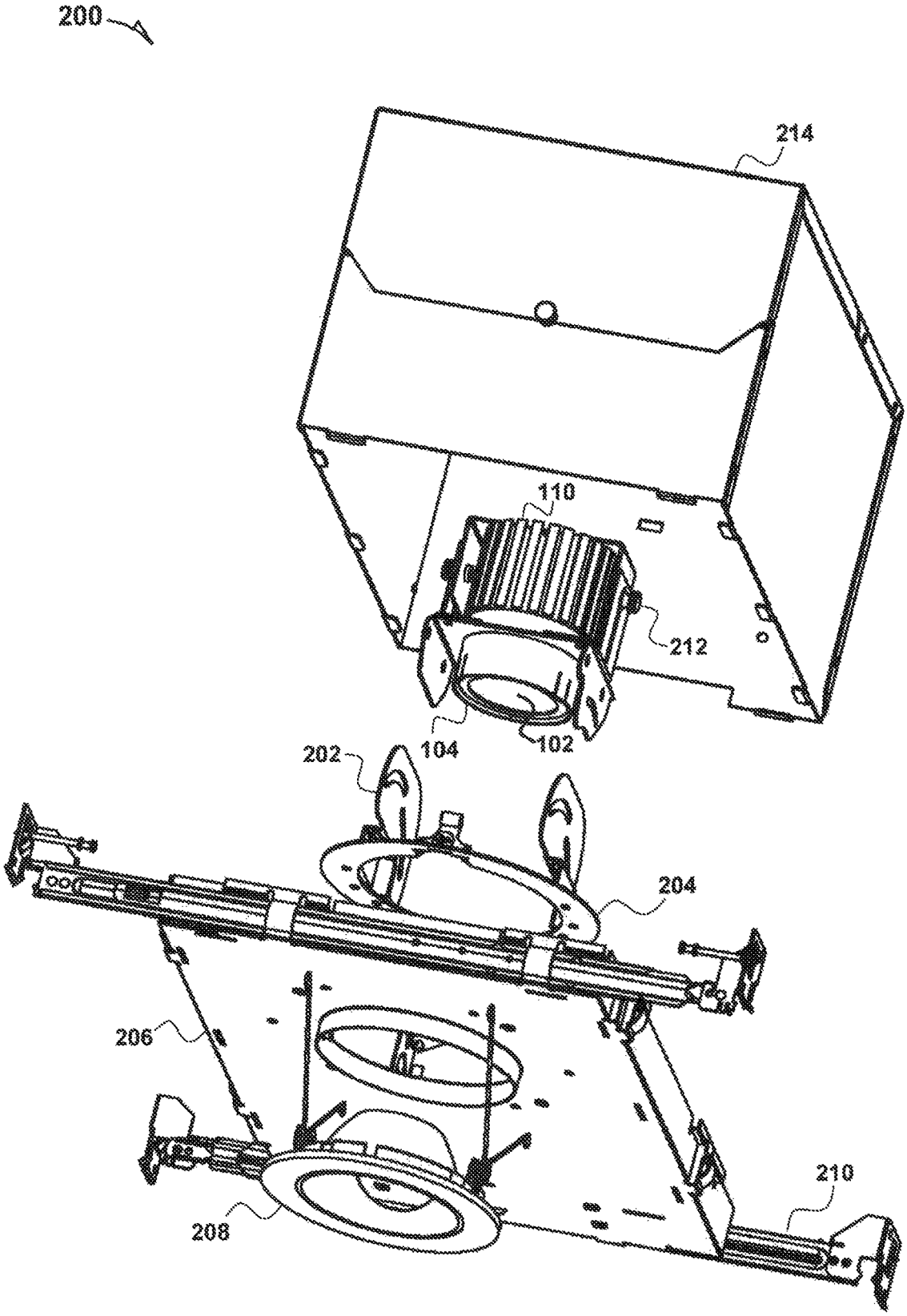
FIG. 2 shows the components of a light fixture, including a light fixture housing and a light fixture body for connection to a support structure, consistent with some embodiments.

FIG. 2 shows the components of a light fixture 200, including a light fixture housing 104 and a light fixture body (e.g., frame 206) for connection to a support structure, consistent with some embodiments.

The light fixture 200 may include the light fixture housing 104 (e.g., for the LCD optic element 102, lens 106, an electronics board 108 of FIG. 1), the heat sink 110, an adjusting member 202, a rotating ring 204, a light fixture body (e.g., frame 206) and a trim 208. The light fixture housing 104 may be attached, at its top, to the adjusting part member 202. The position of the light fixture 200 may be adjusted remotely (e.g., via an electronic device in communication with the wireless chip of electronics board 108), by using a motor to power the rotating ring 204. As shown, fasteners 212 may be used to fasten the top of the heat sink 110 (which is connected to housing 104) to the adjusting member 202 so that a movement of the rotating ring 204 may be transferred to the light fixture housing 104 and the heat sink 110. The trim 208 may be formed from a material (such as wood, metal, or plastic) and used to finish the frame 206 around the opening through which light will be emitted from the LCD optic element 102.

The frame 206 may include a connector (e.g., hanger bars 210) for attachment to a support structure in the form of a ceiling (e.g., attached to a joist) and may also include a junction box 214. The junction box 214 may be a small metal or plastic box that forms part of an electrical conduit or thermoplastic-sheathed cable (TPS) wiring system in a building. The junction box 214 may be used in ceilings, particularly in domestic or commercial buildings.

Figure 3:
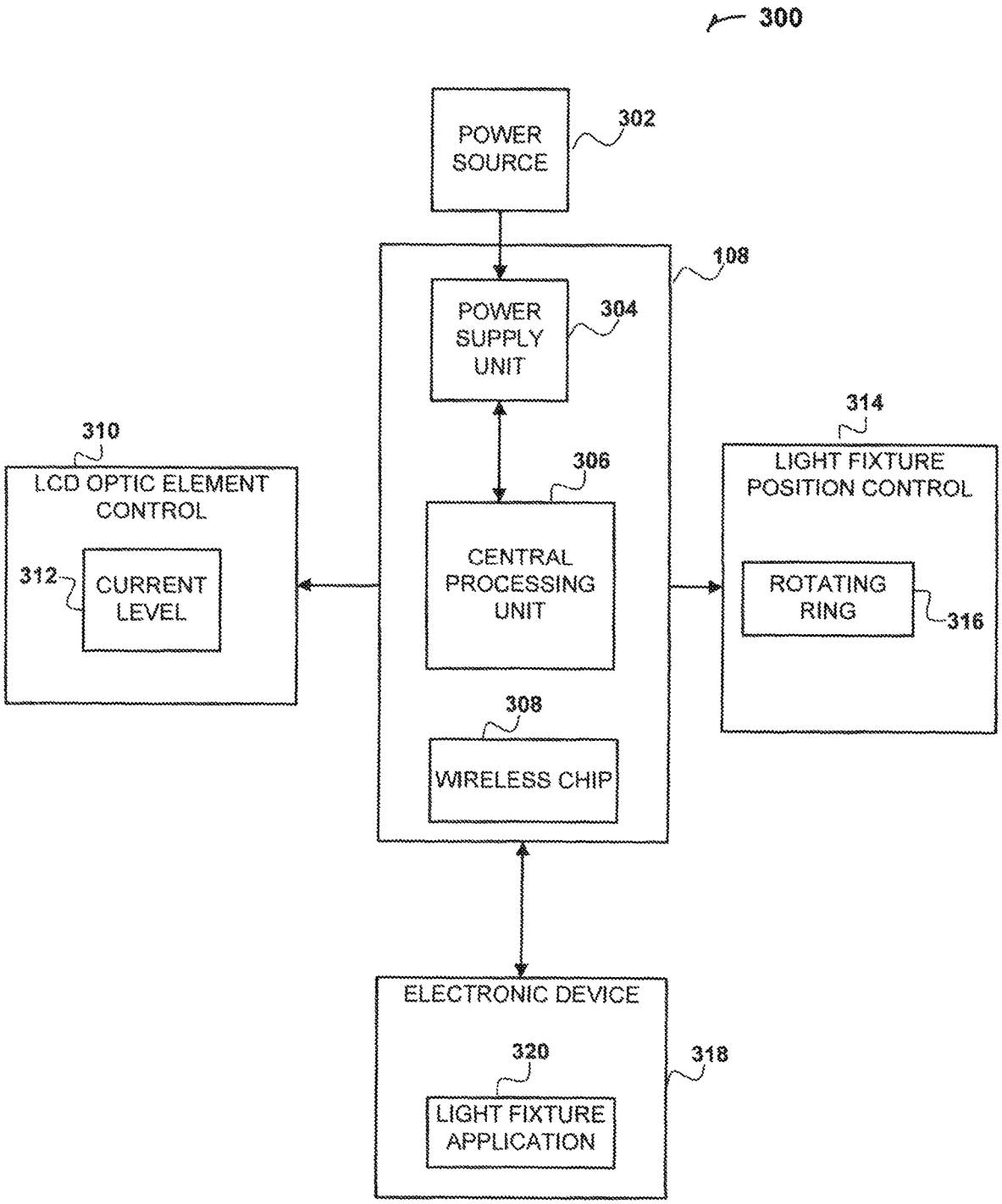
FIG. 3 shows a block diagram of the data flow of a light fixture system with remotely controlled optics, consistent with embodiments described herein.

FIG. 3 shows a block diagram of the data flow of a light fixture system 300 with remotely controlled optics, consistent with embodiments described herein.

The light fixture system 300 may include elements of the light fixture 100 of FIG. 1 and, light fixture 200 of FIG. 2. The light fixture system 300 may include the electronics board 108 and the board 108 it may include a central processing unit (CPU) 306 and a wireless chip 308. The electronics board 108 may receive an instruction from a light fixture application 320 running on an electronic device 318 (e.g., a smartphone) via the wireless chip 308. The light fixture application 320 may provide a user interface (UI) for displaying current conditions of the light fixture system 300 (e.g., intensity, color and/or angle of emitted light) and also provide user input elements for controlling/manipulating the conditions of the light fixture system 300. The instruction received from the light fixture application 320 may be passed from the wireless chip 308 to the CPU 306 so that it can be interpreted and implemented by the CPU 306 via control elements of the light fixture system 300.

For example, a user may desire a different intensity for the light being emitted from the light fixture system 300 and may (e.g., via the of light fixture application 320) send an instruction to increase the intensity by a specified amount (e.g., a percentage amount or a value, such as from 1-10). The CPU 306 may then determine that an LCD optic element control 310 may be used to alter a current level 312 for the LCD optic element 102 so as to increase (or decrease based on a received instruction) an intensity of the light (e.g., from LED light source 316 on electronics board 108) being emitted by the light fixture system 300 through the LCD optic element 102.

The LCD optic element control 310 may use a power supply unit (PSU) 304 (which may be located on or in electrical contact with electronics board 108) to convert the power provided from a power source 302 (e.g., a power outlet) into usable power for the powered elements of the light fixture system 300. For example, the PST 304 may convert an alternating current (AC) supplied by power source 302 into a continuous faint of power, called direct current (DC), required by the powered elements (e.g., CPU 306) of light fixture system 300 to function normally. The DC power provided by the PSU 304 may then be used to alter the current level 312 for the LCD optic element 102 as described above.

The LCD optic element control 310 may also control a color of the light (e.g., as instructed via light fixture application 320) being emitted by light fixture system 300. By controlling the current (e.g., using the power supply unit 304 as described above) that is applied to the each pixel of the LCD optic element 102, light (e.g., from the LED light source 316) may be allowed to pass through the LCD optic element 102 in varying amounts thus producing different levels of gray. Alternatively, the same technique may be used with color LED lights (e.g., from LED light source 316) to generate color pixels (red, green, blue, etc.) on the LCD optic element 102.

The user may also desire a different angle for the light being emitted from the light fixture system 300 and may (e.g., via the UT of light fixture application 320) send an instruction to change the angle by a specified amount (e.g., from 0-90□). The CPU 306 may then determine that a light fixture position control 314 may be used to actuate a rotating ring 204 (e.g., using power provided by the power supply unit 304 as described above) to control an angular position of light fixture housing 104 in order to change the angle by of the light being emitted by the light fixture system 300 as instructed. Alternatively, any type of rotary actuator or linear actuator that allows for precise control of angular (or linear) position may be used by the light fixture position control 314.

Figure 4:
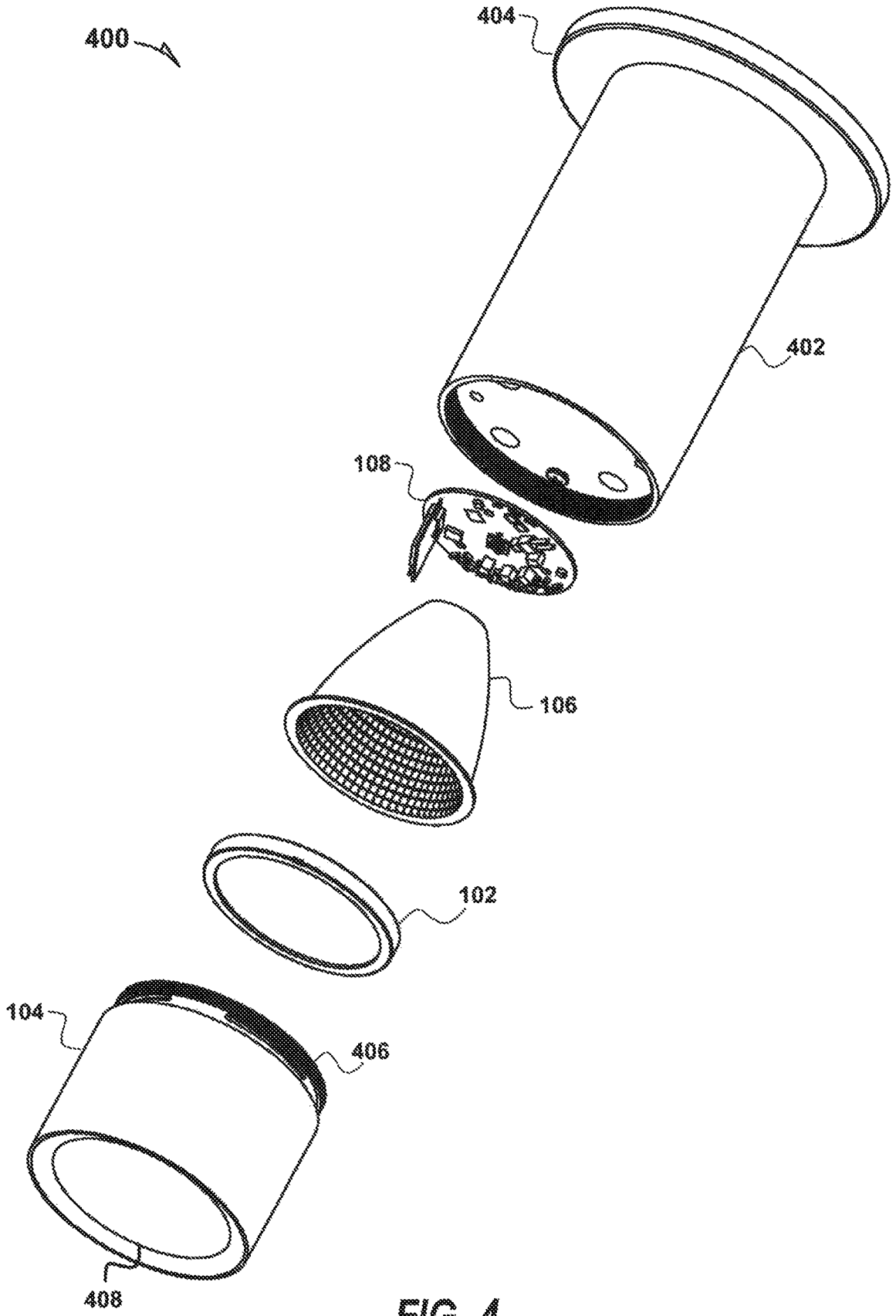
FIG. 4 shows the components of a light fixture, including the light fixture housing and a light fixture body with a connector for connection to a support structure, consistent with some embodiments described herein.

FIG. 4 shows the components of a light fixture 400, including a light fixture housing 104 and a light fixture body (e.g., cylinder 402) with a connector 404 for connection to a support structure, consistent with some embodiments described herein.

The light fixture 400 may include a light fixture body in the form of cylinder 402 and the electronics board 108 may be directly attached to a first circular surface of the cylinder 402. The first circular surface of the cylinder 402 may be recessed and may provide an electrical connection to the power supply 302 for the electronics board 108 (e.g., via power supply unit 304). In an embodiment, the cylinder 402 may be made from a metal that is suitable for acting as a heat sink (e.g., instead of heat sink 110) for the light fixture 400. The cylinder 402 may have a connector 404 attached to a second circular surface of the cylinder 402 that is opposite the first circular surface to which the electronics board 108 may be attached. The connector 404 may comprise the form of a disk that serves to attach the light fixture 400 directly to a support structure such as a wall or ceiling. The light fixture 400 may attach to the support structure at a surface of the connector 404 that is opposite the surface of the connector 404 that is attached to the second circular surface of the cylinder 402.

The lens 106 (which may have a conical frustum shape) may be placed on the electronics board 108 in optical communication with the LED light source 316 of the electronics board 108. The LCD optic element 102 (which may have a circular shape) may be placed on a surface of the lens 106 that is opposite the electronics board 108. The light fixture housing 104 may be in the shape of a hollow cylinder with two open ends wherein one open end 406 may be fastened to the first circular surface of the cylinder 402 or to a top portion of the cylinder 402 near the first circular surface if the first circular surface is recessed as discussed above. The light fixture housing 104 and the cylinder 402 may snap together and/or have complimentary threads for fastening themselves to each other. The LCD optic element 102 may be kept inside the light fixture housing 104 by a flange portion 408 of the light fixture housing 104.

Figure 5A:
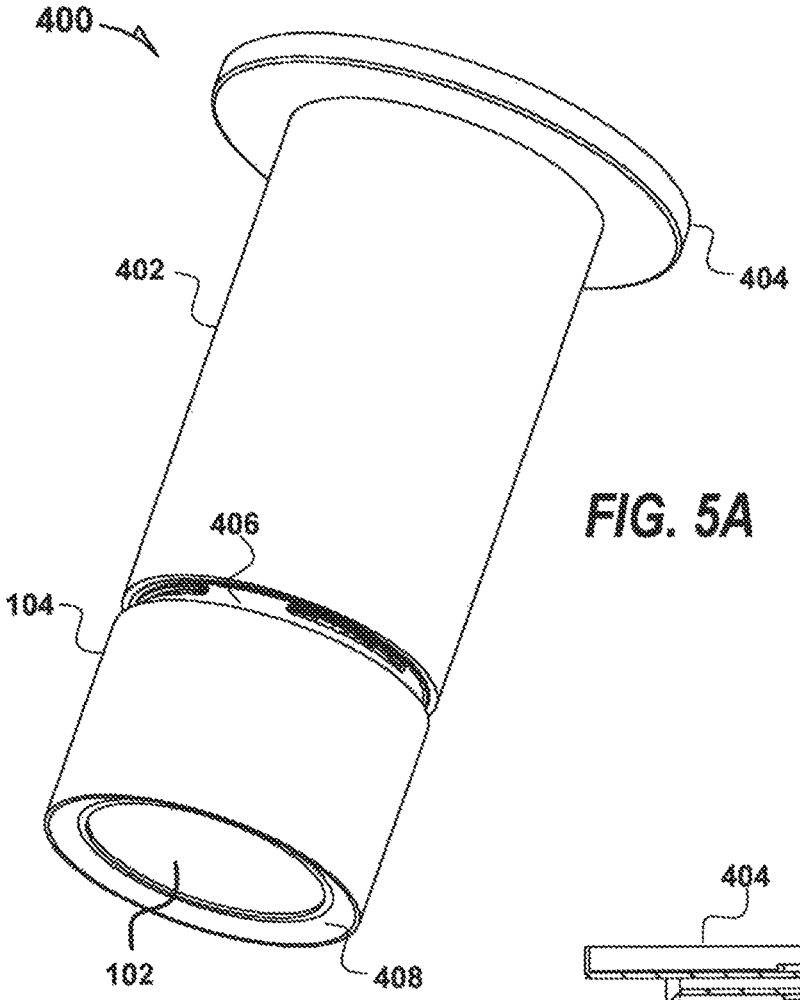
FIGS. 5A-5B show perspective and cross-sectional views of the light fixture, including the light fixture housing fastened to the light fixture body and the connector, consistent with some embodiments described herein.
Figure 5B:
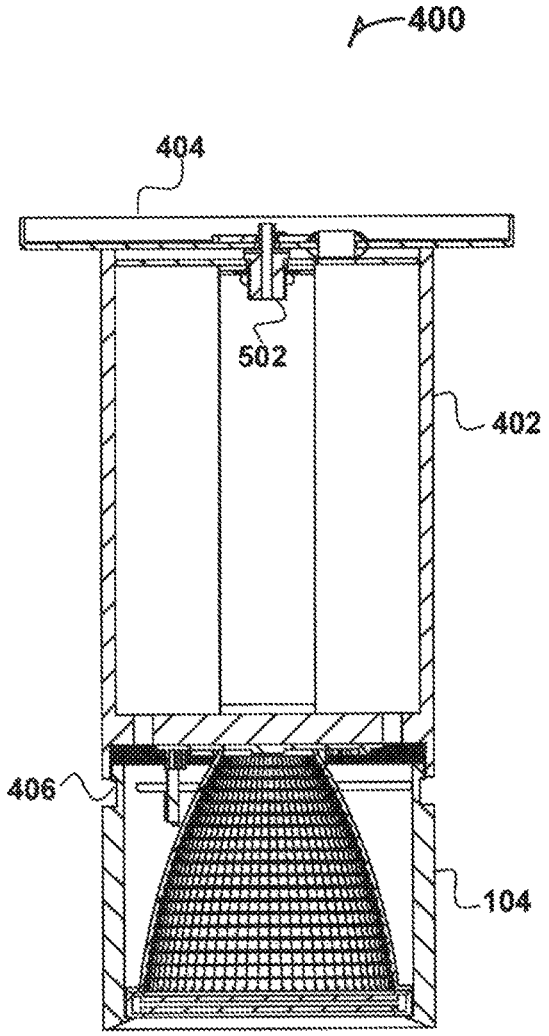

FIGS. 5A-5B show perspective and cross-sectional views of the light fixture 400 with the light fixture housing 104 fastened to the light fixture body (e.g., cylinder 402) and the connector 404, consistent with some embodiments described herein.

FIG. 5A shows a perspective view of the light fixture 400 with the light fixture housing 104 fastened to the light fixture body (e.g., cylinder 402) and the connector 404, consistent with some embodiments described herein.

The elements of light fixture 400 are shown in an assembled state as they would be when attached to a support structure such as a wall or ceiling. The outer surfaces of the connector 404, light fixture body (e.g., cylinder 402), and the light fixture housing 104 (with the open end 406 for fastening to the cylinder 402 and the flange portion 408 for securing the LCD optic element 102) can, be seen in their assembled state. The surface of connector 404 that attaches to the support structure is not visible from the perspective of FIG. 5A.

FIG. 5B shows a cross-sectional view of the light fixture 400 with the light fixture housing 104 fastened to the light fixture body (e.g., cylinder 402) and the connector 404, consistent with some embodiments described herein.

Cross sections of the elements of light fixture 400 are shown in an assembled state as they would be when attached to a support structure such as a wall or ceiling. The cross-sections of the connector 404, light fixture body (e.g., cylinder 402), screw/bolt 502 for joining the connector 404 to the cylinder 402, the light fixture housing 104 (with the open end 406 for fastening to the cylinder 402 and the flange portion 408 for securing the LCD optic element 102), and the LCD optic element 102 can be seen in their assembled state. Cross-sections of some of the internal elements of the light fixture housing 104 may also be seen (e.g., electronics board 108, lens 106 and LCD optic element 102) although these are not numbered as such in FIG. 5B. The screw/bolt 502 may be located within a central portion of the cylinder 402 through which the power source 302 may be electrically connected to the power supply unit 304.

Figure 6A:
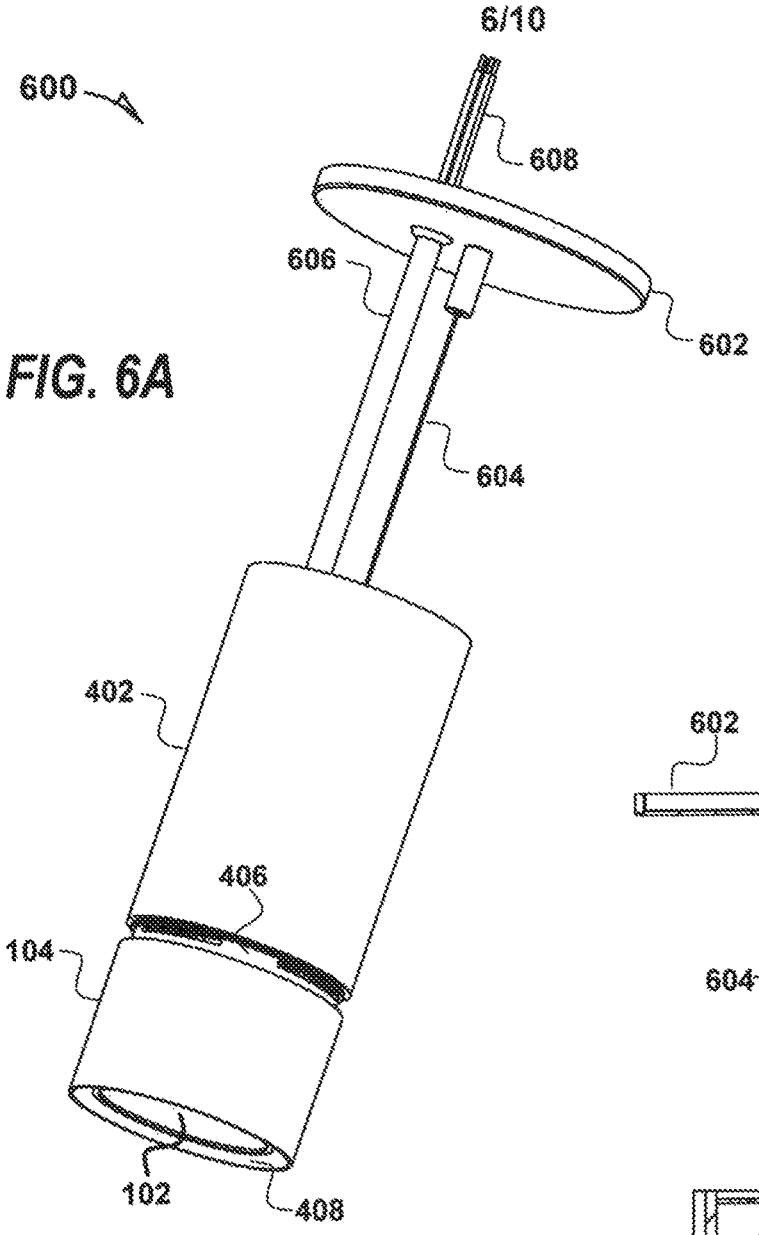
FIGS. 6A-6B show perspective and cross-sectional views of a light fixture, including the light fixture housing fastened to the light fixture body and a connector, consistent with some embodiments described herein.
Figure 6B:
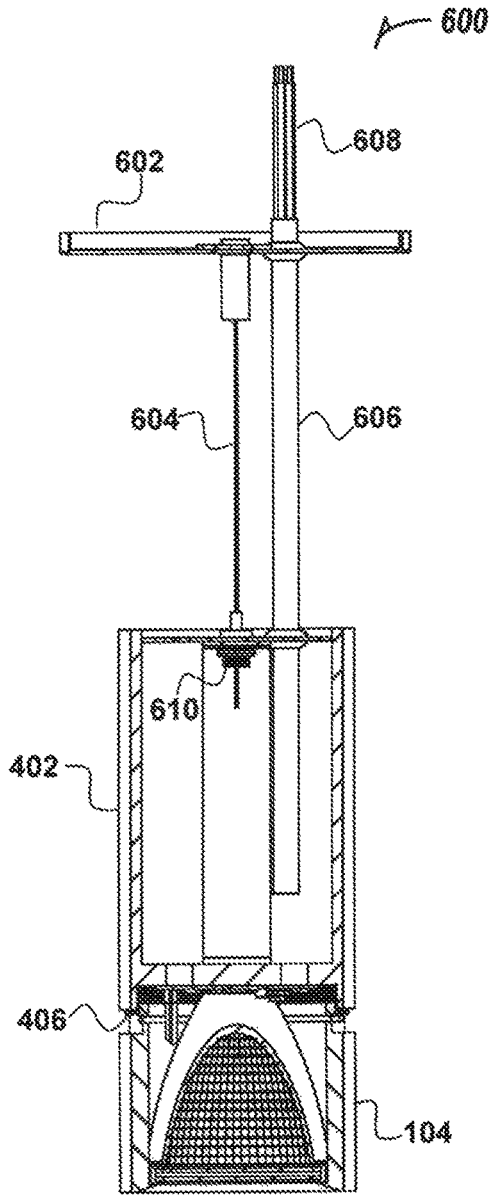

FIGS. 6A-6B show perspective and cross-sectional views of a light fixture 600 with the light fixture housing 104 fastened to the light fixture body (e.g., cylinder 402) and a connector 602, consistent with embodiments described herein.

FIG. 6A shows a perspective view of the light fixture 600 with the light fixture housing 104 fastened to the light fixture body (e.g., cylinder 402) and the connector 602, consistent with some embodiments described herein.

The elements of the light fixture 600 are shown in an assembled state as they would be when attached to an elevated support structure, such as a ceiling, since the light fixture 600 comprises the form of a pendant cylinder. The outer surfaces of the connector 602, light fixture body (e.g., cylinder 402), and the light fixture housing 104 (with the open end 406 for fastening to the cylinder 402 and the flange portion 408 for securing the LCD optic element 102) can be seen in their assembled state. The connector 602 may comprise the form of a disk that serves to attach the light fixture 600 to the support structure. The surface of connector 602 that attaches to the support structure is not visible from the perspective of FIG. 6A.

The connector 602 allows the cylinder 402 to hang down from an elevated supporting structure, such as a ceiling, when a light fixture (e.g., light fixture 600) is desired at a lower altitude. The connector 602 comprises a wire/cable/cord 604 to support the cylinder 402 (and the fastened light fixture housing 104) as it hangs from the support structure. The connector 602 further comprises a tube 606 for the passage of electrical connections 608 between the power source 302 (e.g., in the ceiling or at an outlet reached through the ceiling) and the PSU 304 for electronics board 108 and any other powered elements of light fixture 600.

FIG. 6B shows a cross-sectional view of the light fixture 600 with the light fixture housing 104 fastened to the light fixture body (e.g., cylinder 402) and the connector 602, consistent with some embodiments described herein.

Cross sections of the elements of light fixture 600 are shown in an assembled state as they would be when attached to a support structure, such as a ceiling, since the light fixture 600 comprises the form of a pendant cylinder. The cross-sections of the connector 602, light fixture body (e.g., cylinder 402), a washer/nut 610 for joining the connector 404 to the cylinder 402, the light fixture housing 104 (with the open end 406 for fastening to, the cylinder 402 and the flange portion 408 for securing the LCD optic element 102), and the LCD optic element 102 can be seen in their assembled state. Cross-sections of internal elements of the light fixture housing 104 may also be seen (e.g., electronics board 108, lens 106 and LCD optic element 102) although these are not numbered as such in FIG. 5B.

As noted above, the connector 602 comprises a wire/cable/cord 604 to support the cylinder 402 (and the fastened light fixture housing 104) as it hangs from the support structure. The washer/nut 610 may secure the wire/cable/cord 604 within the central portion of the cylinder 402 through which the power source 302 may be electrically connected to the power supply unit 304. A cross-section of the tube 606 for the passage of electrical connections 608 between the power source 302 (e.g., in the ceiling or at an outlet reached through the ceiling) and the PSU 304 is shown. The interiors of tube 606 and the central portion may be connected within cylinder 402 so that the electrical connections 608 may pass from the tube 606 into the central portion for electrical connection to PSU 304.

Figure 7:
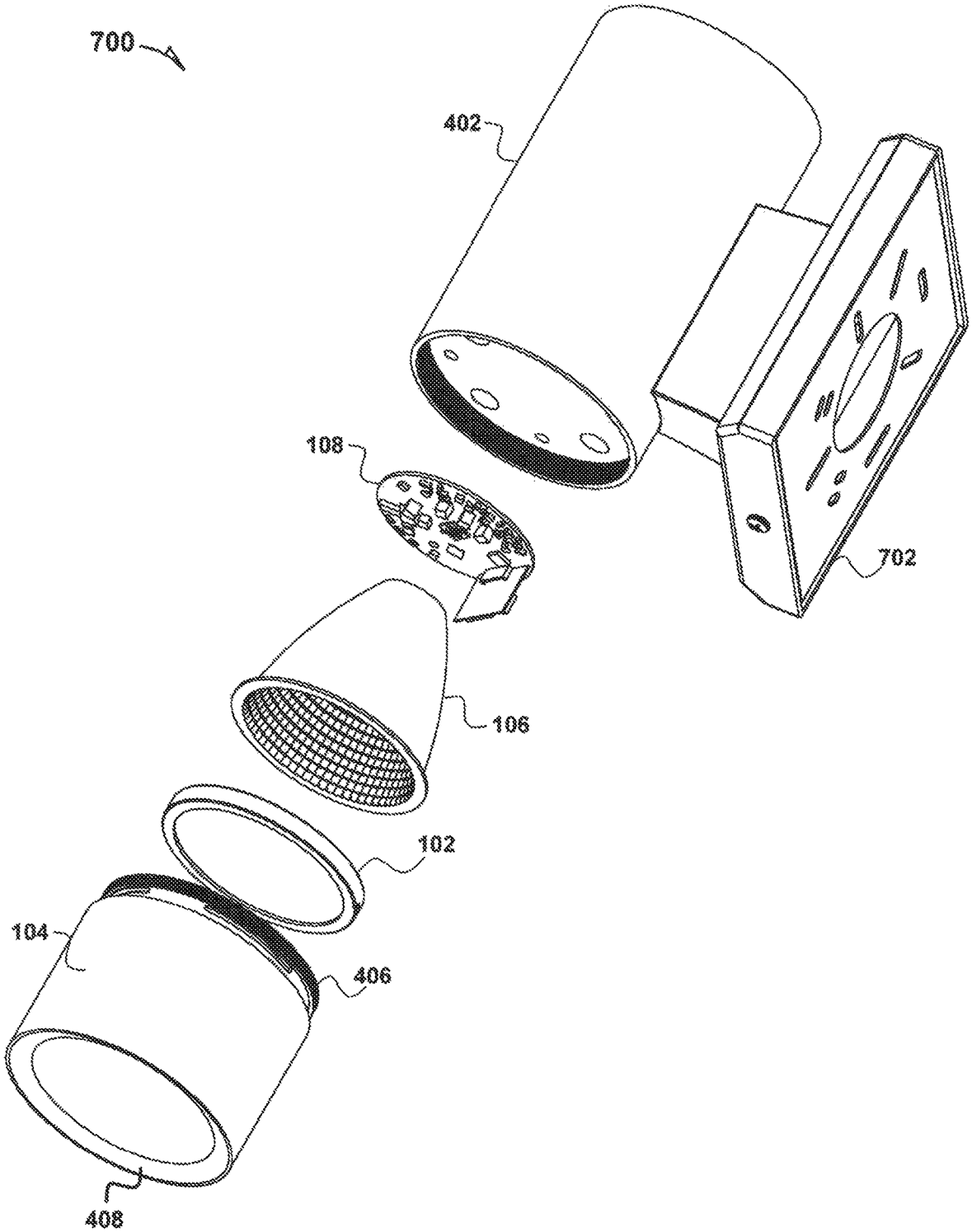
FIG. 7 shows the components of a light fixture, including the light fixture housing and the light fixture body with a connector for connection to a support structure, consistent with some embodiments described herein.

FIG. 7 shows the components of a light fixture 700, including the light fixture housing 104 and the light fixture body (e.g., cylinder 402) with a connector 702, consistent with embodiments described herein.

The light fixture 700 may include, a light fixture body in the form of cylinder 402 and the electronics board 108 may be directly attached to a first circular surface of the cylinder 402. The first circular surface of the cylinder 402 may be recessed and may provide an electrical, connection to the power supply 302 for the electronics board 108 (e.g., via power supply unit 304). In an embodiment, the cylinder 402 may be made from a metal that is suitable for acting as a heat sink (e.g., instead of heat sink 110) for the light fixture 700. The cylinder 402 may have a connector 702 attached to the rectangular surface of the cylinder 402.

The connector 702 may comprise the form of a rectangular platform that serves to attach the light fixture 400 directly to a support structure such as a wall or ceiling in a manner that leaves a lower profile with respect to the support structure than connector 404 of FIGS. 4 and 5A-5B. This is based on the circumference of the first and second circular surfaces of cylinder 402 and the height of the connector 702 combined being smaller than the distance between the first and second circular surfaces of cylinder 402. The light fixture 700 may attach to the support structure at a surface of the connector 702 that is opposite the surface of the connector 702 that is attached to the rectangular surface of the cylinder 402.

The lens 106 (which may have a conical frustum shape) may be placed on the electronics board 108 in optical communication with the LED light source 316 of the electronics board 108. The LCD optic element 102 (which may have a circular shape) may be placed on a surface of the lens 106 that is opposite the electronics board 108. The light fixture housing 104 may be in the shape of a hollow cylinder with two open ends wherein one open end 406 may be fastened to the first circular surface of the cylinder 402. The light fixture housing 104 and the cylinder 402 may snap together and/or have complimentary threads for fastening themselves to each other. The LCD optic element 102 may be kept inside the light fixture housing 104 by a flange portion 408 of the light fixture housing 104.

Figure 8A:
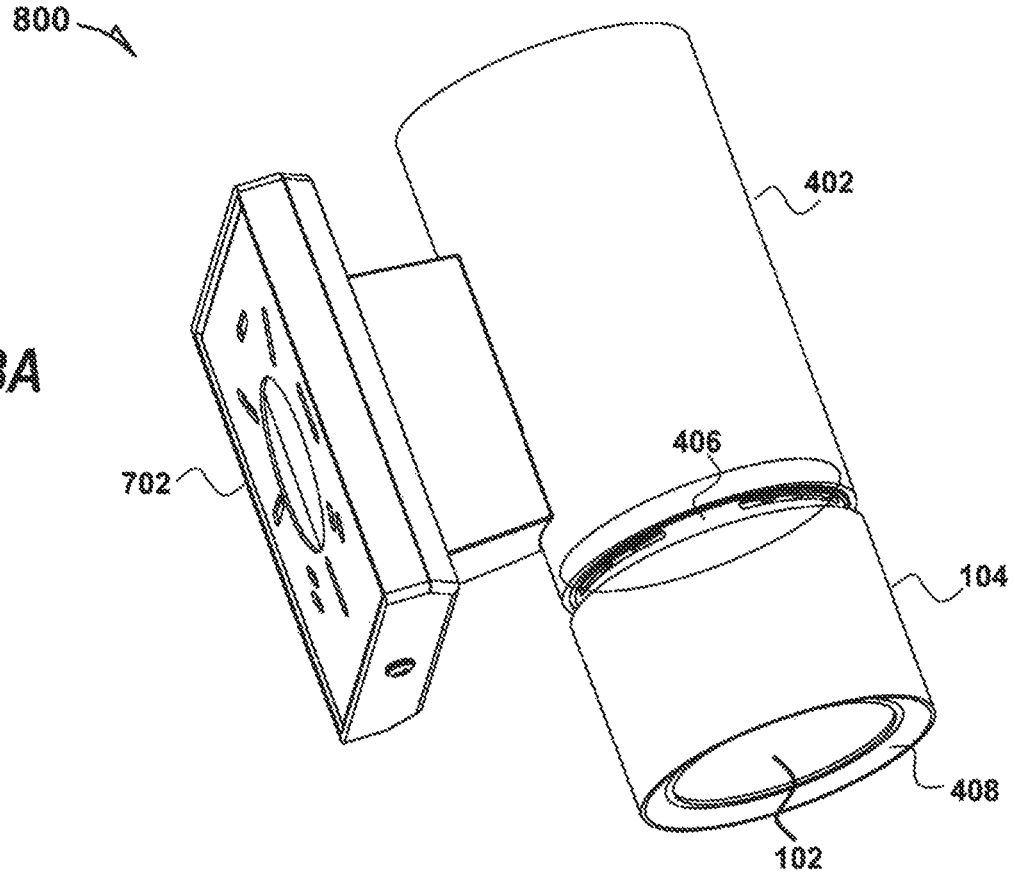
FIGS. 8A-8B show perspective and cross-sectional views of the light fixture, including the light fixture housing fastened to the light fixture body and the connector, consistent with some embodiments described herein.
Figure 8B:
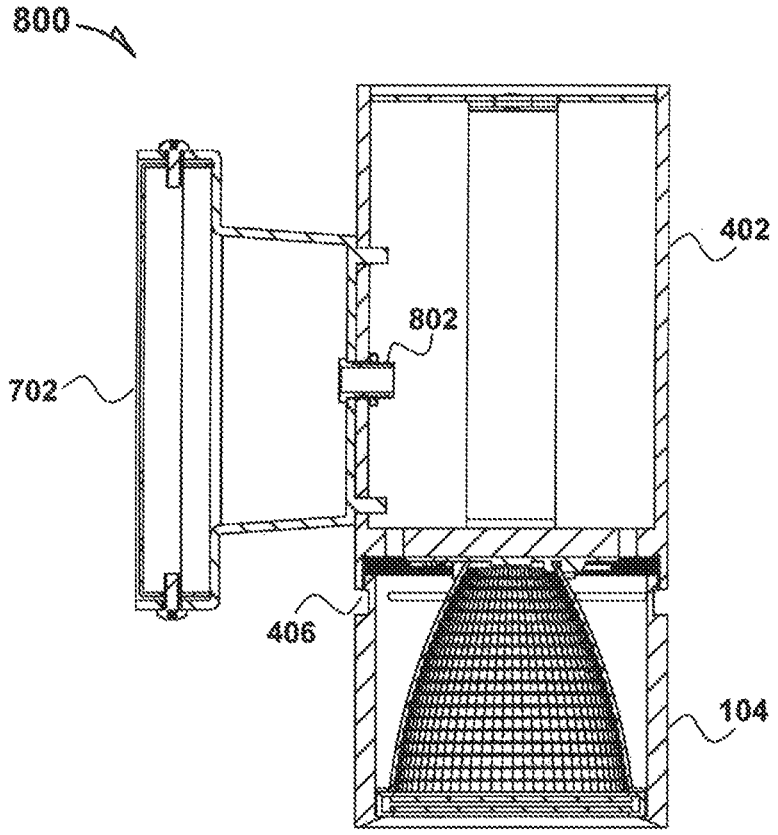

FIGS. 8A-8B show perspective and cross-sectional views of the light fixture 700 with the light fixture housing 104 fastened to the light fixture body (e.g., cylinder 402) with the connector 702, consistent with some embodiments described herein.

FIG. 8A shows a perspective view of the light fixture 700 with the light fixture housing 104 fastened to the light fixture body (e.g., cylinder 402) and the connector 404, consistent with some embodiments described herein.

The elements of light fixture 700 are shown in an assembled state as they would be when attached to a support structure such as a wall or ceiling. The outer surfaces of the connector 702, light fixture body (e.g., cylinder 402), and the light fixture housing 104 (with the open end 406 for fastening to the cylinder 402 and the flange portion 408 for securing the LCD optic element 102) can be seen in their assembled state. The surface of connector 702 that attaches to the support structure is visible from the perspective of FIG. 8A, showing a circular opening 802 through which electrical wires may pass in order to connect the power supply 302 to the PSU 304 for powered elements of light fixture 700 (e.g., electronics board 108).

FIG. 8B shows a cross-sectional view of the light fixture 700 with the light fixture housing 104 fastened to the light fixture body (e.g., cylinder 402) and the connector 702, consistent with some embodiments described herein.

Cross sections of the elements of light fixture 700 are shown in an assembled state as they would be when attached to a support structure such as a wall or ceiling. The cross-sections of the connector 404, light fixture body (e.g., cylinder 402), screw/bolt 804 for joining the connector 702 to the cylinder 402, the light fixture housing 104 (with the open end 406 for fastening to the cylinder 402 and the flange portion 408 for securing the LCD optic element 102), and the LCD optic element 102 can be seen in their assembled state. Cross-sections of some of the internal elements of the light fixture housing 104 may also be seen (e.g., electronics board 108, lens 106 and LCD optic element 102) although these are not numbered as such in FIG. 8B. An interior of the screw/bolt 804 may connect the circular opening 802 of connector 702 with the central portion of the cylinder 402 through which the power source 302 may be electrically connected to the power supply unit 304. A cross-section of the screw/bolt 804 for the passage of electrical connections between the power source 302 (e.g., in the ceiling or at an outlet reached through the ceiling) and the PSU 304 is shown. The interiors of screw/bolt 804 and the central portion may be connected within cylinder 402 so that the electrical connections may pass from the connector 702 through the screw/bolt 804 into the central portion for electrical connection to PSU 304.

Figure 9:
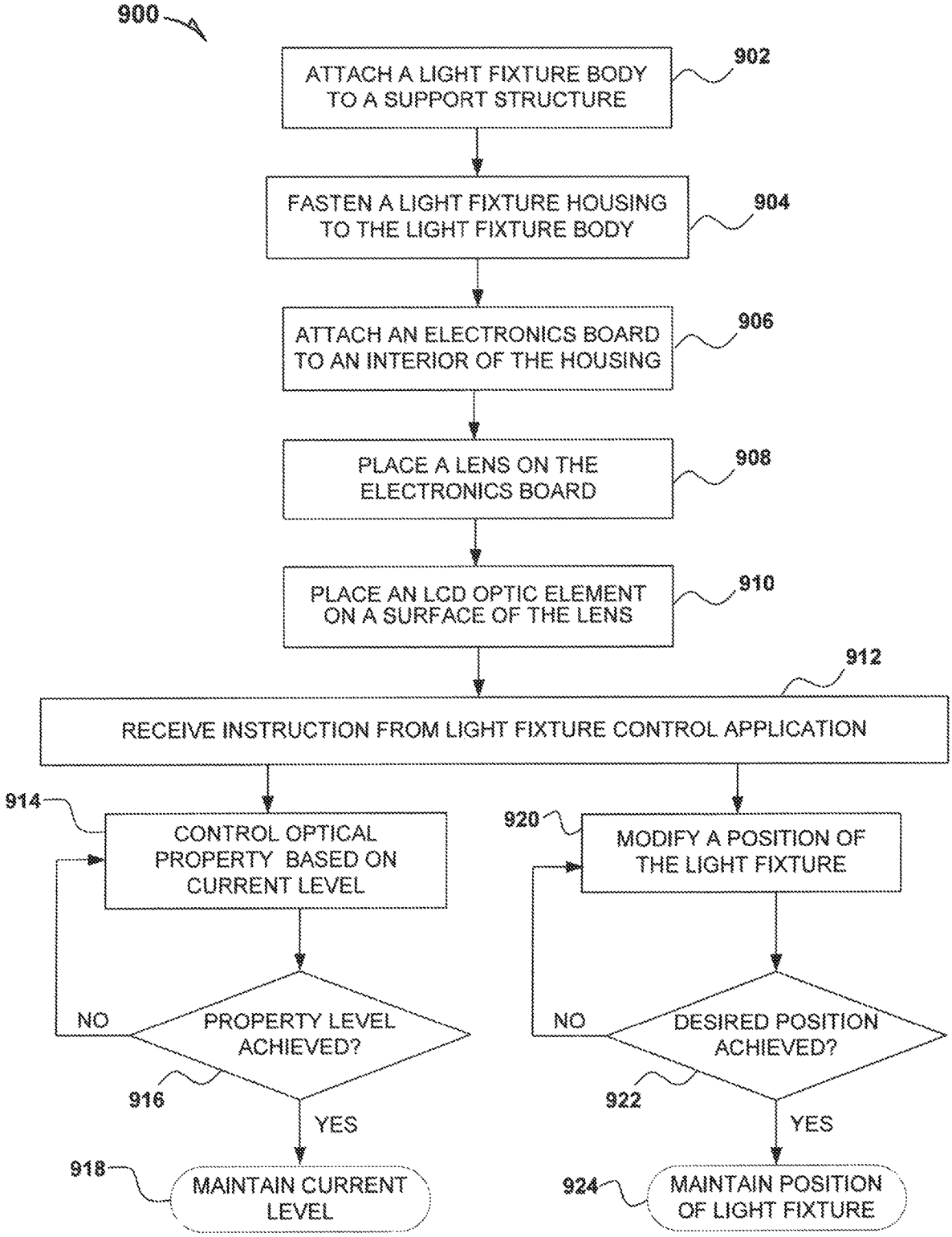
FIG. 9 shows a flow diagram illustrating a method, consistent with some embodiments, for controlling the optics and positioning of a light fixture connected to a support structure.

FIG. 9 shows a flow diagram illustrating a method 900, consistent with some embodiments, for controlling the optics and positioning of a light fixture (e.g., light fixtures 100, 200, 400, 600 and 700) connected to a support structure.

The method 900 for controlling a light fixture may begin with a step 902 that comprises attaching a light fixture body (e.g., frame 206 or cylinder 402) to a support structure such as a wall or ceiling. A connector (e.g., 210, 404, 602 and 702) may be used to attach the light fixture body to the support structure.

The method 900 for controlling a light fixture may continue with a step 904 that comprises fastening a light fixture housing (e.g., light fixture housing 104) to the light fixture body (e.g., frame 206 or cylinder 402). As noted above, the light fixture housing 104 may be in the shape of a hollow cylinder with two open ends wherein one open end 406 may be fastened to the first circular surface of the cylinder 402. The light fixture housing 104 and the cylinder 402 may snap together and/or have complimentary threads for fastening themselves to each other.

The method 900 for controlling a light fixture may continue with a step 906 that comprises attaching an electronics board (e.g., electronics board 108) to an interior of the light fixture housing (e.g., light fixture housing 104).

The method 900 for controlling a light fixture may continue with a step 908 that comprises placing a lens (e.g., lens 106) on a surface of the electronics board (e.g., electronics board 108) that is opposite the surface of the electronics board that is attached to the interior of the light fixture housing (e.g., housing 104).

The method 900 for controlling a light fixture may continue with a step 910 that comprises placing an LCD optic element (e.g., LCD optic element 102) on a surface of the lens (e.g., lens 106) opposite the surface of the lens that is in contact with the electronics board (e.g., electronics board 108).

The method 900 for controlling a light fixture may continue with a step 912 that comprises receiving an instruction, via a wireless chipset (e.g., wireless chip 308) on the electronics board (e.g., electronics board 108), from a light fixture control application (e.g., light fixture control application 320) running on an electronic device (e.g., electronic device 318). The method 900 may then proceed to step 914 or 920 based on a received instruction, as explained below.

The method 900 for controlling a light fixture may continue with a step 914 that comprises using a current/voltage level (applied to the LCD optic element 102) to control an optical property (e.g., intensity, color, etc.) of light emitted from the light fixture based on the instruction received at step 912.

The method 900 for controlling a light fixture may continue with a step 916 that comprises determining whether the desired level for the optical property (according to the received instruction) of light emitted from the light fixture has been achieved with the applied current/voltage level. If not, then the method 900 may return to step 914 to modify the current/voltage level being applied to the LCD optic element 102. If so, then the method 900 may proceed to step 916 and maintain the current/voltage level being applied to the LCD optic element 102.

The method 900 for controlling a light fixture may continue with a step 920 that comprises actuating a motor (e.g., rotating ring 204) to control a position (e.g., linear or rotational) of the light fixture based on the instruction received from the light fixture application (e.g., light fixture application 320) at step 912.

The method 900 for controlling a light fixture may continue with a step 922 that comprises determining whether the desired position (according to the received instruction) for the light fixture has been achieved with the actuation of the motor. If not, then the method 900 may return to step 920 to further modify the position of the light fixture. If so, then the method 900 may proceed to step 924 and maintain the present position of the light fixture.

Figure 10:
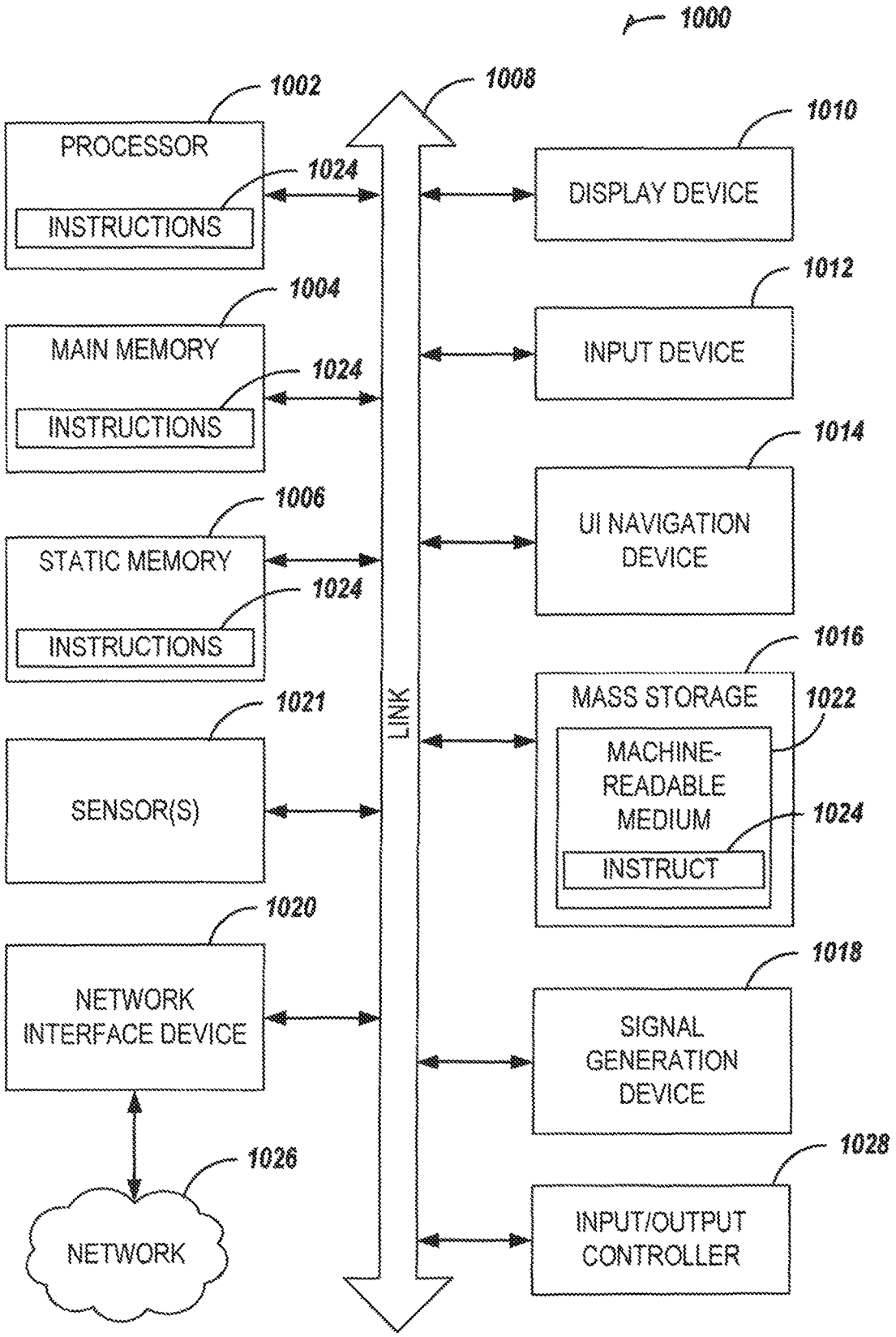
FIG. 10 shows a block diagram illustrating a machine in the form of a computer system, within which a set or sequence of instructions may be executed to cause the machine to operate according to embodiments discussed herein.

FIG. 10 is a block diagram illustrating a machine in the form of computer system 1000, within which a set or sequence of instructions may be executed to cause the machine to operate according to embodiments discussed herein.

In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be an onboard vehicle system, wearable device, personal computer (PC), a tablet PC, a hybrid tablet, a personal digital assistant (FDA), a mobile telephone, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein. Similarly, the term "processor-based system" shall be taken to include any set of one or more machines that are controlled by or operated by a processor (e.g., a computer) to individually or jointly execute instructions to perform any one or more of the methodologies discussed herein.

Example computer system 1000 includes at, least one processor 1002 (e.g., a central processing unit (CPU), a graphics processing unit (GPU) or both, processor cores, compute nodes, etc.), a main memory 1004 and a static memory 1006, which communicate with each other via a link 1008 (e.g., bus). The computer system 1000 may further include a video display unit 1010, an alphanumeric input device 1012 (e.g., a keyboard), and a user interface (UI) navigation device 1014 (e.g., a mouse). In one embodiment, the video display unit 1010, input device 1012 and UI navigation device 1014 are incorporated into a touch screen display. The computer system 1000 may additionally include a storage device 1016 (e.g., a drive unit), a signal generation device 1018 (e.g., a speaker), a network interface device 1020, and one or more sensors (not shown), such as a global positioning system (GPS) sensor, compass, accelerometer, gyrometer, magnetometer, or other sensor.

The storage device 1016 includes a machine-readable medium 1022 on which is stored one or more sets of data structures and instructions 1024 (e.g., software) embodying or utilized by any one or, more of the methodologies or functions described herein. The instructions 1024 may also reside, completely or at least partially, within the main memory 1004, static memory 1006, and/or within the processor 1002 during execution thereof by the computer system 1000, with the main memory 1004, static memory 1006, and the processor 1002 also constituting machine-readable media.

While the machine-readable medium 1022 is illustrated in an example embodiment to be a single medium, the term "machine-readable medium" may include a single medium or multiple media (e.g., a centralized or distributed database, and/or associated caches and servers) that store the one or more instructions 1024. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include volatile or non-volatile memory, including but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 1024 may further be transmitted or received over a communications network 1026 using a transmission medium via the network interface device 1020 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., 3G, and 4G LTE/LTE-A or WiMAX networks). The input/output controller 1028 may serve as an interface between an external input or output device and the computer system 1000.

Embodiments may be implemented in one or a combination of hardware, firmware, and software. Embodiments may also be implemented as instructions stored on a machine-readable storage device, which may be read and executed by at least one processor to perform the operations described herein. A machine-readable storage device may include any non-transitory mechanism for storing information in a form readable by a machine (e.g., a computer).

What is claimed is:

1. A light fixture comprising:

a fixture body configured for attachment to a support structure;

a fixture housing fastened to the fixture body;

an electronics hoard attached to an interior of the housing;

a lens on the electronics board; and an LCD optic element on a surface of the lens opposite the electronics board, wherein an optical property of a light emitted from the light fixture is based on a current applied to the LCD optic element;

wherein the fixture body comprises a frame with hanger bars for attachment to the support: structure, wherein the frame comprises a motor driving a rotating ring coupled to the housing.

2. The light fixture of claim 1, wherein the lens is in optical communication with an LED light source on the electronics board.

3. The light fixture of claim 1, further comprising a heat sink in contact with the electronics hoard.

4. The light fixture system of claim 1, wherein activation of the motor is based on an instruction received, from an electronic device, via a wireless communication chip on the electronics hoard.

5. The light fixture of claim 1, wherein the frame comprises a junction box.

6. The light fixture of claim 1, wherein the fixture body comprises a cylinder and the fixture housing is fastened to a first circular surface of the cylinder.

7. The light fixture of claim 6, wherein the cylinder is configured to function as a heat sink.

8. The light fixture of claim 6, wherein the cylinder comprises a connector, on a second circular surface of the cylinder, for attachment to the support structure.

9. The light fixture of claim 8, wherein the connector is configured to hang the cylinder from the support structure.

10. The light fixture of claim 6, wherein the cylinder comprises a connector, on a rectangular surface of the cylinder, for attachment to the support structure.

11. The light fixture of claim 1, further comprising a wireless communication chip on the electronics board, wherein the current applied to the LCD optic element is based on an instruction received, from an electronic device, via the wireless communication chip.

12. The light fixture of claim 1, wherein the optical property comprises an intensity of the light emitted from the system.

13. The light fixture of claim 1, wherein the optical property comprises a color of the light emitted from the system.

14. The light fixture of claim 1, wherein the optical property comprises an angle of the light emitted from the system.

15. A light fixture system comprising:

a fixture control application running on an electronic device;

a fixture body configured for attachment to a support structure;

a fixture housing fastened to the fixture body;

an electronics board attached to an interior of the fixture housing;

a lens on the electronics board; and an LCD optic element on a surface of the lens opposite the electronics board, wherein an optical property of a light emitted from the light fixture is based on a current applied to the LCD optic element, wherein the fixture body comprises a frame with hanger bars for attachment to the support structure, wherein the frame comprises a motor driving a rotating ring coupled to the housing.

16. The light fixture system of claim 15, wherein the current applied to the LCD optic element is based on an instruction received, from the fixture control application, via a wireless chipset on the electronics board.

17. A method for controlling a light fixture, comprising:

attaching a light fixture body to a support structure;

fastening a light fixture housing to the fixture body;

attaching an electronics board to an interior of the fixture housing;

placing a lens on the electronics board; and controlling an optical property of a light emitted from the light fixture based on a current applied to an LCD optic element on a surface of the lens opposite the electronics board;

wherein the fixture hod comprises a frame with hanger bars attachment to the support structure, wherein the frame comprises a motor driving a rotating ring coupled to the housing.

18. The method of claim 17, further comprising:

receiving an instruction, via a wireless chipset on the electronic board, from a fixture control application running on the electronic device; and basing the current applied to the LCD optic element on the instruction.

* * * * *